US011174879B2

(12) United States Patent
Hasegawa et al.

(10) Patent No.: US 11,174,879 B2
(45) Date of Patent: Nov. 16, 2021

(54) INDUSTRIAL EJECTOR HAVING IMPROVED SUCTION PERFORMANCE

(71) Applicant: Japan Aerospace Exploration Agency, Tokyo (JP)

(72) Inventors: Susumu Hasegawa, Tokyo (JP); Kouichiro Tani, Tokyo (JP)

(73) Assignee: JAPAN AEROSPACE EXPLORATION AGENCY

( * ) Notice: Subject to any disclaimer, the term of this patent is extended or adjusted under 35 U.S.C. 154(b) by 0 days.

(21) Appl. No.: 16/562,617

(22) Filed: Sep. 6, 2019

(65) Prior Publication Data

US 2020/0080572 A1 Mar. 12, 2020

(30) Foreign Application Priority Data

Sep. 10, 2018 (JP) ..... JP2018-168959

(51) Int. Cl.
*F04F 5/46* (2006.01)
*F04F 5/20* (2006.01)

(52) U.S. Cl.
CPC ..... *F04F 5/465* (2013.01); *F04F 5/20* (2013.01)

(58) Field of Classification Search
CPC ..... F04F 5/02; F04F 5/04; F04F 5/10; F04F 5/14; F04F 5/16; F04F 5/20; F04F 5/24; F04F 5/46; F04F 5/465
See application file for complete search history.

(56) References Cited

U.S. PATENT DOCUMENTS 4,632,649 A * 12/1986 Segebrecht ..... F04F 5/46 417/151
5,159,961 A * 11/1992 Snetting ..... F04F 5/16 137/223
9,822,738 B2 * 11/2017 Bittner ..... F04F 5/46

FOREIGN PATENT DOCUMENTS

| | | | |
|---|---|---|---|
| JP | S59-188099 | A | 10/1984 |
| JP | 2003-056500 | A | 2/2003 |
| JP | 2004-270460 | A | 9/2004 |
| JP | 2008-133796 | A | 6/2008 |
| JP | 2011-117349 | A | 6/2011 |
| JP | 2017-155621 | A | 9/2017 |

OTHER PUBLICATIONS

Japanese Office Action, dated Oct. 27, 2020, issued in corresponding Japanese Patent Application No. 2018-168959. English translation. Total 6 pages.

* cited by examiner

*Primary Examiner* — Bryan M Lettman
(74) *Attorney, Agent, or Firm* — Ostrolenk Faber LLP

(57) ABSTRACT

An industrial ejector includes: a Laval nozzle in which a first channel which has a throat and along which a fluid flows in a first direction is formed; and a main body which is formed in a tubular shape, in which the Laval nozzle disposed therein is fixed to a part of an inner surface thereof, and in which a second channel is formed between the rest of the inner surface and the Laval nozzle. The second channel is disposed at a first side with respect to the first channel in a second direction perpendicular to the first direction. An opening is obliquely cut and formed in an end of the first channel at a downstream side and inclined toward the first side in the downstream direction and then toward the second channel.

5 Claims, 7 Drawing Sheets

INDUSTRIAL EJECTOR HAVING IMPROVED SUCTION PERFORMANCE

BACKGROUND OF THE INVENTION

Field of the Invention

The present invention relates to an industrial ejector.

Priority is claimed on Japanese Patent Application No. 2018-168959, filed Sep. 10, 2018, the content of which is incorporated herein by reference.

Description of Related Art

An industrial ejector is a fluid pump that ejects fluid such as water vapor from nozzles and inhales another fluid using negative pressure of the nozzle exit, and is used in an industrial ejector or the like (see, for example, Patent Documents 1 to 3). That is, the industrial ejector that ejects a primary flow at a high speed, and inhales ambient fluid as a secondary flow.

Further, the industrial ejectors are used, for example, in apparatuses for furnace filtration, distillation, infiltration, absorption, drying, mixing, vacuum transportation, vacuum cooling, water cooling, and dewatering in the field of plants.

Patent Document 1: Japanese Unexamined Patent Application, First Publication No. 2003-56500

Patent Document 2: Japanese Unexamined Patent Application, First Publication No. 2011-117349

Patent Document 3: Japanese Unexamined Patent Application, First Publication No. 2017-155621

Typical performance properties of the variations in suction flow rate of the secondary flow with respect to the pressure of the primary flow of a conventional industrial ejector is depicted by a solid line L1 in FIG. 7. The vertical axis of FIG. 7 indicates the suction performance. When the Mach number is 1, the flow rate of a fluid flowing through the throat of the industrial ejector is maximized. The suction performance represents the ratio of the flow rate of a fluid that actually flows through the throat to the maximum flow rate of fluid that flows through the throat. The suction performance is a value smaller than or equal to 1.

As the suction performance increases, the suction flow rate of the secondary flow increases.

As depicted by the line L1, when the pressure of the primary flow is increased, the suction performance increases, and the suction flow rate of the secondary flow increases. However, air in the inhaled secondary flow is choked when the pressure of the primary flow reaches Pss. When the pressure of the primary flow is further increased, the suction flow rate of air of the secondary flow starts to decrease at the pressure of the primary flow is Pse. In addition, when the pressure of the primary flow is further increased, the air of the secondary flow cannot flow into the industrial ejector at the pressure of the primary flow is Pe.

A negative aspect of the performance property depicted by the line L1 is that, when the pressure of the primary flow is increased, the suction performance deteriorates. It is preferable for the suction performance to be high even though the pressure of the primary flow is increased, as is the case with the performance property depicted by the dotted line L2.

Another negative aspect of the performance property depicted by the alternate long and short dashed line L3 is that, even when the pressure of the primary flow is increased, the suction performance does not reach the choke state. It is desirable that the suction performance can reach the choke state as indicated by the line L1 or the line L2.

SUMMARY OF THE INVENTION

The present invention provides an industrial ejector in which suction performance is improved.

According to a first aspect of the present invention, an industrial ejector includes: a Laval nozzle in which a first channel which has a throat and along which fluid flows in a first direction is formed; and a main body which is formed in a tubular shape, in which the Laval nozzle disposed therein is fixed to part of an inner surface thereof, and in which a second channel is formed between the rest of the inner surface and the Laval nozzle. The second channel is disposed at a first side with respect to the first channel in a second direction perpendicular to the first direction. An opening formed in an end of the first channel at a downstream side is inclined toward the first side in the downstream direction.

According to the aspect of the present invention, for example, in a case where the Mach number of the flow velocity of the fluid flowing through the throat is 1, pressure of the fluid drops at the downstream side of the throat in the first channel. Since the opening of the first channel is inclined toward the first side as it goes toward the downstream side, the fluid in which pressure has dropped flows toward the first side as it goes toward the downstream side. The second fluid is efficiently inhaled through the second channel by the fluid in which pressure has dropped. Therefore, the suction performance of the industrial ejector can be improved.

Further, in the above industrial ejector, an angle formed by the first direction and the opening may be greater than 0° and smaller than 90°.

According to the aspect of the present invention, the fluid in which pressure has dropped at the downstream side of the throat in the first channel flows toward the first side in a more appropriate direction, and thus the suction performance of the industrial ejector can be further improved.

Further, in the above industrial ejector, the Mach number of the flow velocity of the fluid flowing in the throat may be 1.

According to the industrial ejector described above, suction performance can be improved.

DETAILED DESCRIPTION OF THE INVENTION

Hereinafter, an embodiment of an industrial ejector according to the present invention will be described with reference to FIGS. 1 to 6.

Figure 1:
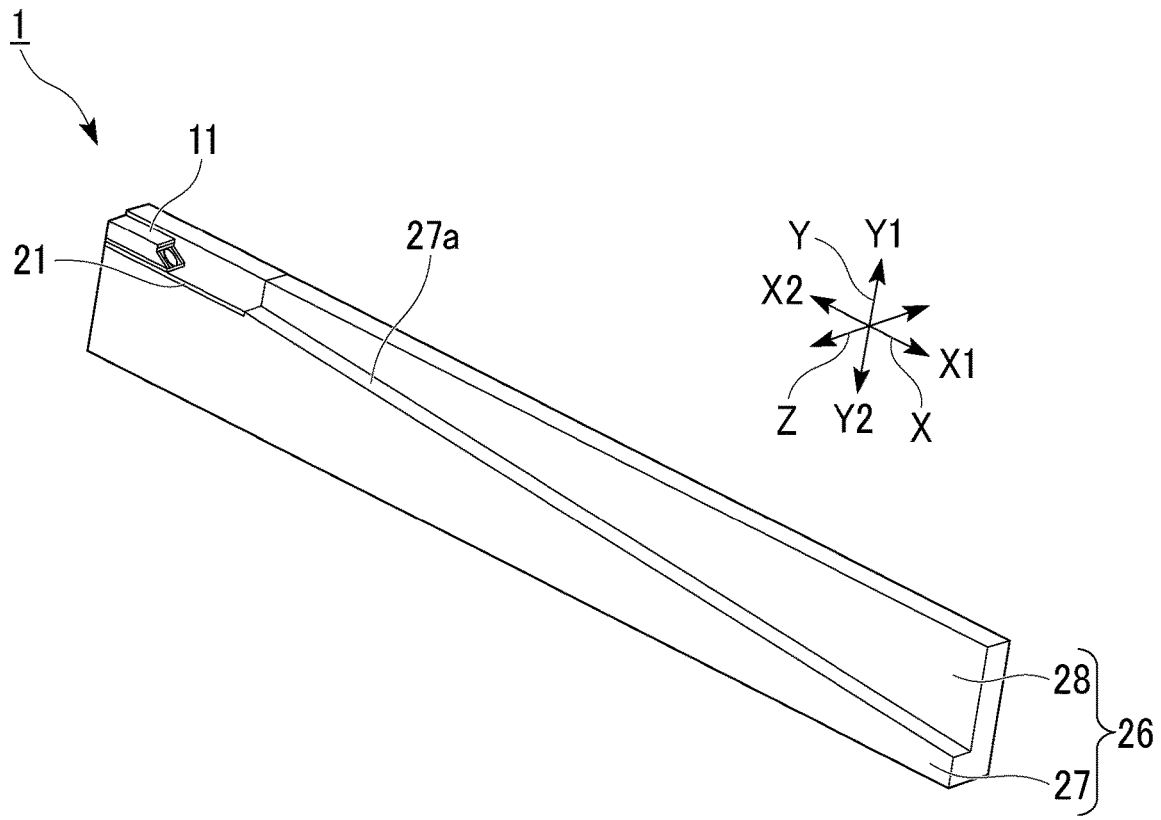
FIG. 1 is a perspective view of an industrial ejector of an embodiment of the present invention.
Figure 2:
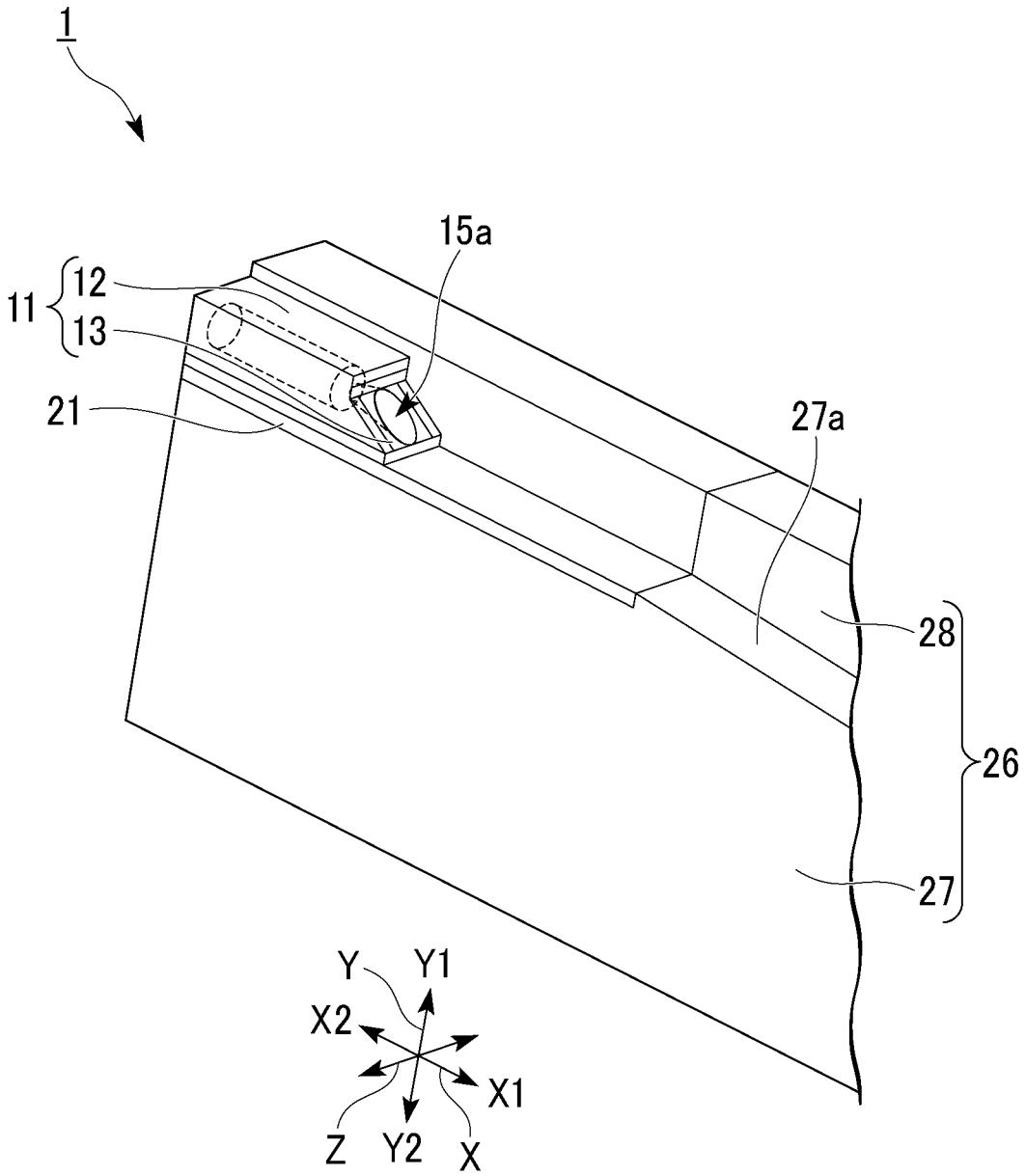
FIG. 2 is an enlarged view of relevant parts in FIG. 1.
Figure 3:
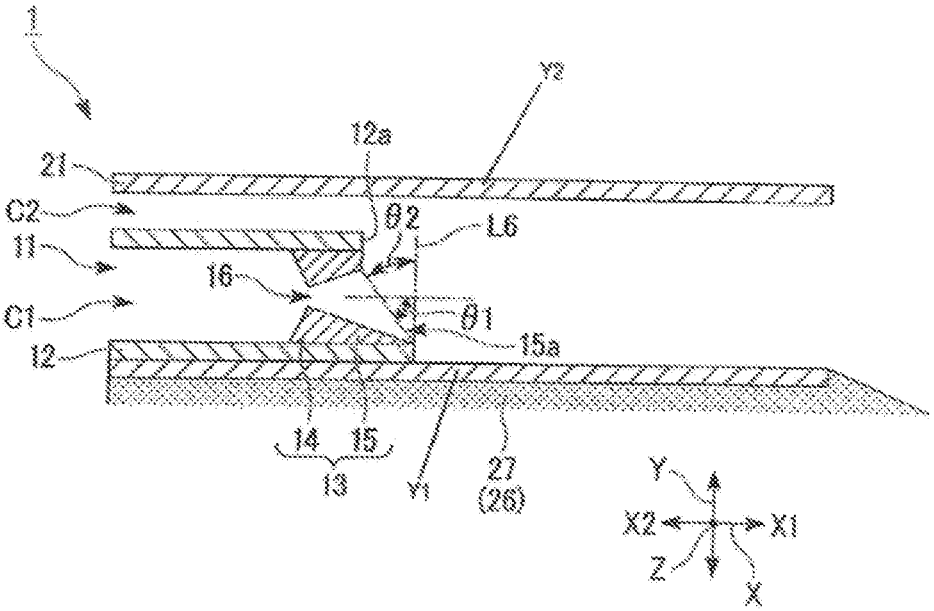
FIG. 3 is a sectional view of relevant parts in FIG. 2.

As shown in FIGS. 1 to 3, an industrial ejector 1 of the present embodiment includes a Laval nozzle 11, a chamber (a main body) 21, and a guide member 26. In FIGS. 1 and 2 and FIGS. 5 and 6 to be described below, part of the chamber 21 is not shown.

As shown in FIG. 3, a first channel C1 along which a first fluid flows is formed in the Laval nozzle 11, and a second channel C2 along which second fluid flows is formed in the chamber 21.

The Laval nozzle 11 includes a tubular part 12 and a protrusion 13. The shape of the tubular part 12 is not limited to configurations of the embodiments. In the present embodiment, the tubular part 12 is formed in an angled tubular shape in which the cross section perpendicular to a longitudinal direction has a rectangular shape. A first direction X in which the first fluid flows in the tubular part 12 is a direction along an axis of the tubular part 12.

A cutout 12*a* is formed in an end of the tubular part 12 at a downstream side X1 at which the first fluid flows in the tubular part 12. The downstream side X1 is one side in the first direction X.

Here, a direction in which the second channel C2 is located relative to the first channel C1 is defined as a first side Y1 in a second direction Y perpendicular to the first direction X. The cutout 12*a* is formed at the first side Y1 of the tubular part 12.

Either gas such as nitrogen or fuel is used as the first fluid. Air or the like may be the second fluid.

The protrusion 13 is formed in a square or rectangular prism shape. An internal space of the protrusion 13 constitutes part of the first channel C1. The protrusion 13 is fixed to an inner circumferential surface of the end of the tubular part 12 at the downstream side X1.

The protrusion 13 includes a diameter-reducing portion 14 and an enlarged diameter portion 15.

The diameter-reducing portion 14 is formed such that a cross-sectional area of the first channel C1 which is perpendicular to the first direction X is reduced toward the downstream side X1. On the other hand, the enlarged diameter portion 15 is formed such that the cross-sectional area of the first channel C1 which is perpendicular to the first direction X is enlarged toward the downstream side X1. In the present embodiment, the first channel C1 in the enlarged diameter portion 15 has a conical shape. An opening 15*a* formed in an end of the enlarged diameter portion 15 at the downstream side X1 serves as an opening formed in an end of the first channel C1 at the downstream side X1.

The opening 15*a* is a portion that opens to an end face of the first channel C1 at the downstream side X1. As shown in FIG. 2, the opening 15*a* has an elliptical shape.

As shown in FIG. 3, a throat 16 is formed at the protrusion 13 as the first channel C1 at a connection portion between the diameter-reducing portion 14 and the enlarged diameter portion 15. The cross-sectional area of the first channel C1 which is perpendicular to the first direction X is smallest at the throat 16.

The opening 15*a* is inclined to be approaching to the first side Y1 toward the downstream side X1.

An angle θ1 formed by the first direction X and the opening 15*a* shown in FIG. 3 is greater than 0°, and is smaller than 90°. The angle θ1 is an angle that is formed by the axis along the first direction X and the opening 15*a*, and an angle that is formed at the downstream side X1 relative to the opening 15*a* and at a second side Y2 which is a side opposite to the first side Y1 relative to the axis.

An angle θ2 at which the opening 15*a* is directed closer to the second channel C2 than the first direction X is greater than 0°, and is smaller than 90°. The angle θ2 is a value obtained by subtracting the angle θ1 from 90°.

The Laval nozzle 11 configured in this way is not configured to be rotational symmetry around the axis along the first direction X.

The chamber 21 is formed in an angled tubular shape (a tubular shape) in which a cross section perpendicular to the first direction X that is the longitudinal direction has a rectangular shape. An inner diameter of the chamber 21 is larger than an outer diameter of the Laval nozzle 11.

The Laval nozzle 11 is disposed inside the chamber 21. The Laval nozzle 11 is fixed to a portion of an inner surface of the chamber 21 at the second side Y2 (part of the inner surface).

The aforementioned second channel C2 is formed between the inner surface of the chamber 21 at the first side Y1 (the rest of the inner surface) and the Laval nozzle 11. The second channel C2 communicates with the opening 15*a* of the Laval nozzle 11 from the first side Y1 of the opening 15*a*.

The chamber 21 extends to the downstream side X1 relative to the Laval nozzle 11.

As shown in FIGS. 1 and 2, the guide member 26 includes a first guide member 27 and a second guide member 28.

The first guide member 27 is fixed to an outer surface of the chamber 21 at the second side Y2. The first guide member 27 extends to the downstream side X1 than the chamber 21. An outer surface 27*a* of the first guide member 27 which continues into an inner surface of the chamber 21 at the second side Y2 is inclined toward the second side Y2 as it goes toward the downstream side X1.

The second guide member 28 is fixed to an outer surface of the first guide member 27 in a third direction Z perpendicular to each of the first direction X and the second direction Y. The second guide member 28 protrudes to the first side Y1 relative to the first guide member 27.

Next, an operation of the industrial ejector 1 configured as described above will be described.

The first fluid flows in the first channel C1 of the Laval nozzle 11 from an upstream side X2. The first fluid is throttled by the throat 16, so that the flow velocity thereof rises, and the pressure thereof drops. In this case, flow rate of the first fluid flowing in the first channel C1 is preferably adjusted such that the Mach number of the flow velocity of the first fluid flowing through the throat 16 becomes 1.

The pressure of the first fluid throttled by the throat 16 drops in the enlarged diameter portion 15 at the downstream side X1 relative to the opening 15*a* in the first channel C1. In this case, the flow velocity of the first fluid reaches supersonic velocity. Since the opening 15*a* is inclined toward the first side Y1 as it goes toward the downstream side X1, the first fluid in which pressure has dropped flows toward the first side Y1 as it heads for the downstream side X1. The second fluid is efficiently inhaled in through the second channel C2 by the first fluid whose pressure has dropped.

The first fluid and the second fluid that are joined to each other flow to the downstream side X1 along the guide member 26.

As described above, according to the industrial ejector 1 of the present embodiment, the suction performance of the industrial ejector 1 can be improved.

The angle θ1 is greater than 0° and is smaller than 90°. The angle θ2 is greater than 0° and is smaller than 90°.

The angle θ1 is set to be greater than 0° and to be smaller than 90°, and thus the first fluid in which pressure has dropped at the downstream side X1 than the throat 16 in the first channel C1 flows toward the first side X1 in a more appropriate direction, such that the suction performance of the industrial ejector 1 can be further improved.

Here, results of simulating suction performance of industrial ejectors of embodiments and a comparative example will be described. Suction performance of each industrial ejector was calculated by changing the pressure of the first fluid in the Laval nozzle at a stagnation point.

The industrial ejectors of the embodiments had angles θ1 set to 30°, 45° and 60°. The industrial ejector of the comparative example had an angle θ1 set to 90°.

Figure 4:
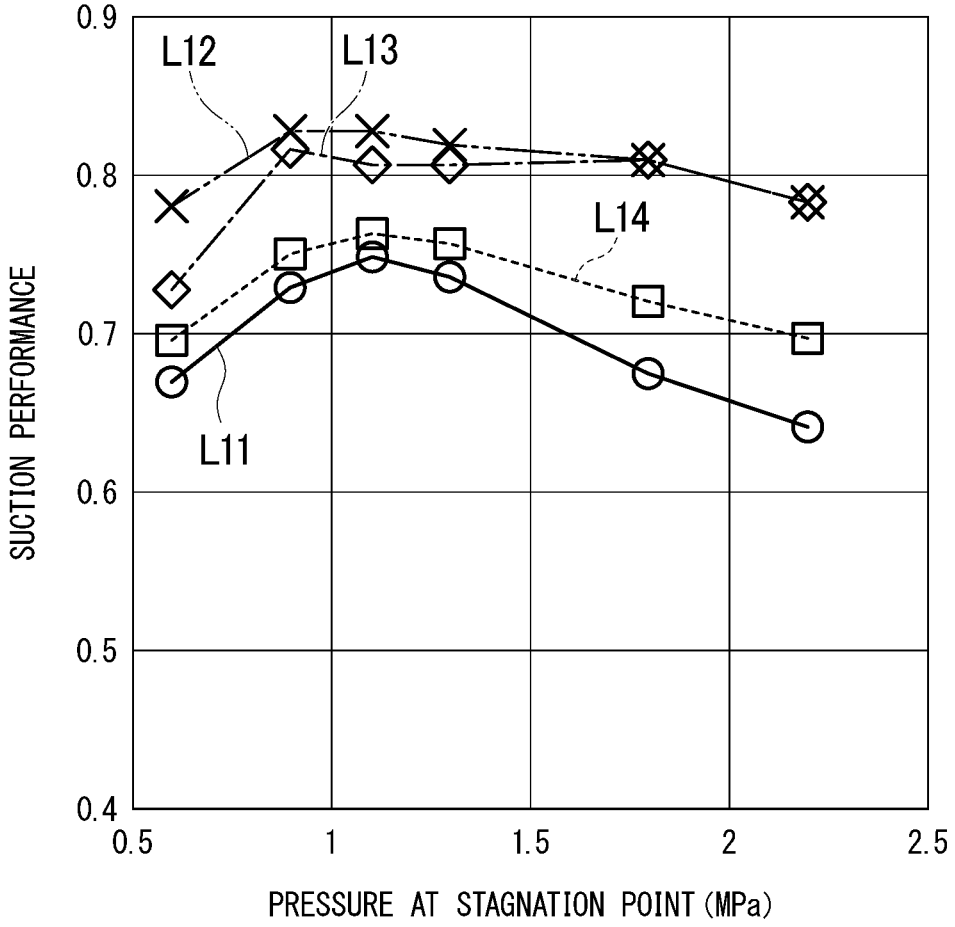
FIG. 4 is a view showing a relationship between suction performance and pressure of the industrial ejector at a stagnation point.

Simulated results are shown in FIG. 4. In FIG. 4, the horizontal axis indicates a pressure (MPa) at a stagnation point, and the vertical axis indicates suction performance. Pressure at a stagnation point becomes rocket pressure when the industrial ejector is used in a rocket.

In place of the pressure of the first fluid in the Laval nozzle at the stagnation point, total pressure or the like of the first fluid in the Laval nozzle may be used.

The solid line L11 represents the industrial ejector of the comparative example. The alternate long and two short dashed line L12 represents the industrial ejector of the embodiments in which the angle θ1 is 30°. The alternate long and short dashed line L13 represents the industrial ejector of the embodiments in which the angle θ1 is 45°. The dotted line L14 represents the industrial ejector of the embodiments in which the angle θ1 is 60°.

In the industrial ejector of the comparative example, as the pressure at a stagnation point rises from about 0.6 MPa to about 1.1 MPa, the suction performance becomes high. In a case where the pressure at the stagnation point is higher than about 1.1 MPa, the pressure at the stagnation point becomes high, and thus the suction performance becomes low.

Meanwhile, in the industrial ejectors of the embodiments, even if the pressure at a stagnation point ranges from about 0.6 MPa to about 2.2 MPa, the suction performance becomes higher than that of the industrial ejector of the comparative example.

At all ranges of pressure at the stagnation point from about 0.6 MPa to about 2.2 MPa, the suction performance of the industrial ejectors in which the angles θ1 are 30° and 45° becomes higher than the suction performance of the industrial ejector in which the angle θ1 is 60°. The suction performance of the industrial ejector in which the angle θ1 is 30° becomes higher than the suction performance of the industrial ejector in which the angle θ1 is 45° in a range in which the pressure at a stagnation point ranges from about 0.6 MPa to about 1.8 MPa or less.

The angle θ1 is preferably 15° or greater and 75° or smaller, more preferably 30° or greater and 60° or smaller, and most preferably 40° or greater and 50° or smaller.

Even when the aforementioned suction performance does not reach the choke state in the industrial ejector of the comparative example, by setting the angle θ1 of the industrial ejector 1 of the embodiments greater than 0°, the suction performance reaches to the choke state. The angle θ1 is adjusted, and thus performance suitable for the use of the industrial ejector can be obtained.

Figure 5:
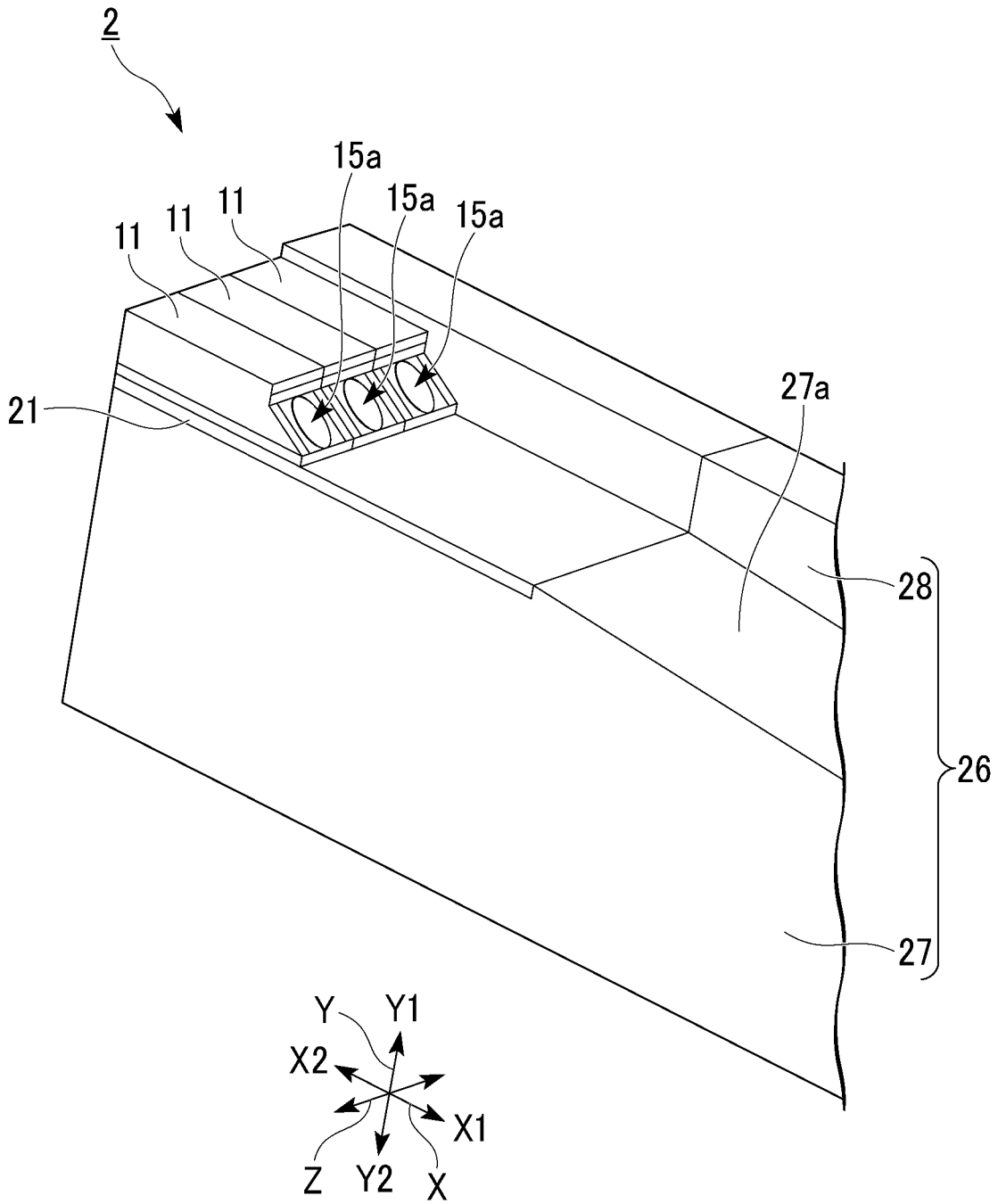
FIG. 5 is a perspective view of an industrial ejector in a modified example of the embodiment of the present invention.

In the present embodiment, as shown in FIG. 5, an industrial ejector 2 may include a plurality of Laval nozzles 11 (three Laval nozzles 11 in this modified example). The plurality of Laval nozzles 11 are disposed in the third direction Z side by side. The number of Laval nozzles 11 installed in the industrial ejector is not limited.

Figure 6:
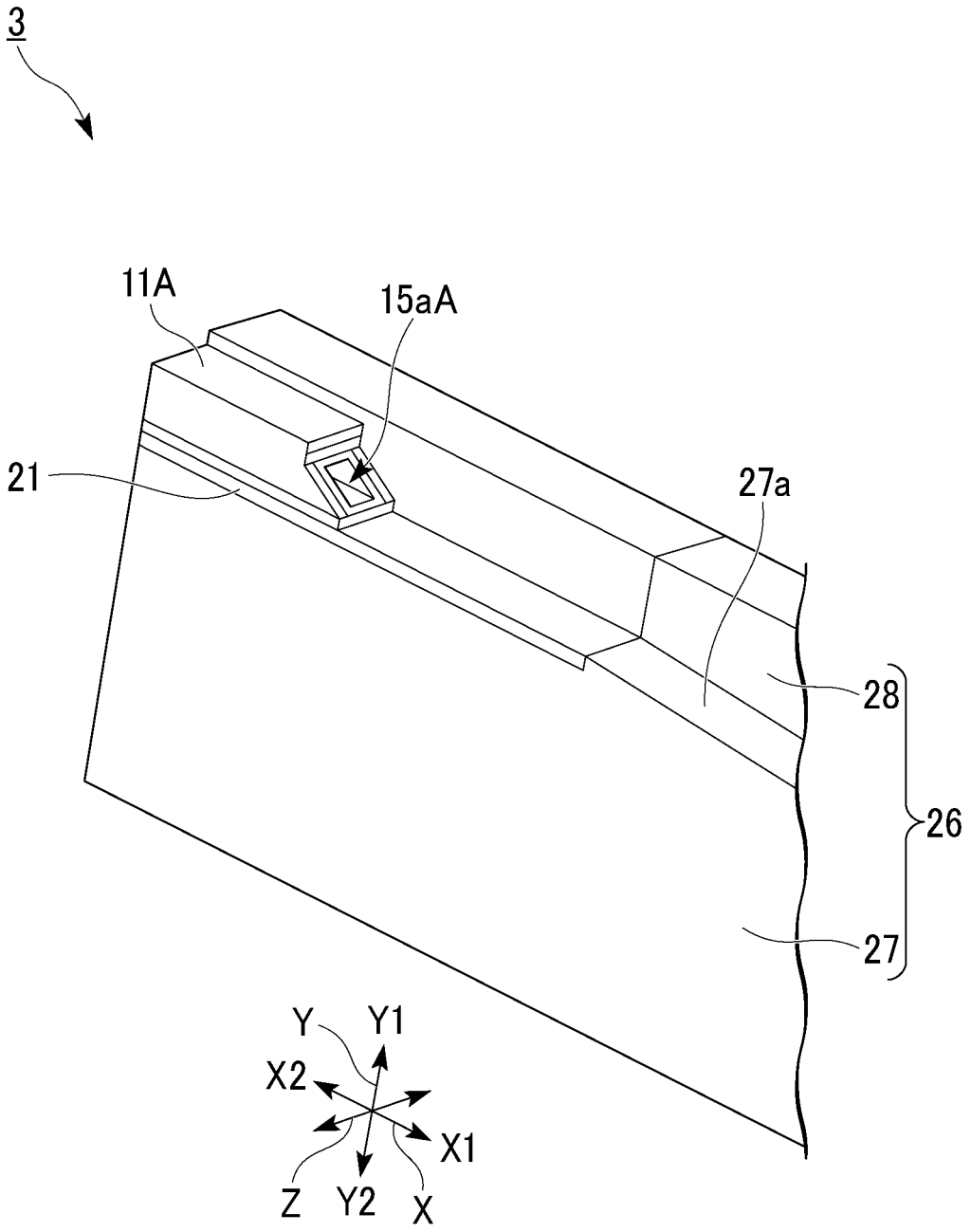
FIG. 6 is a perspective view of an industrial ejector in another modified example of the embodiment of the present invention.
Figure 7:
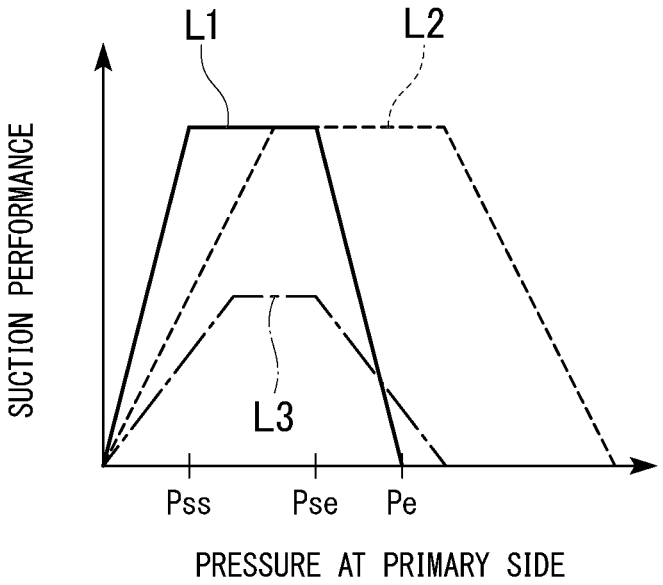
FIG. 7 is a view showing a relationship of suction performance to pressure of primary flow in a conventional industrial ejector.

Further, as shown in FIG. 6, an industrial ejector 3 may include a Laval nozzle 11A having a rectangular opening 15*a*A.

While an embodiment of the invention has been described in detail with reference to the drawings, the specific constitution is not limited to the embodiment, and also includes modifications, combinations, and eliminations, and so on of the constitution without departing from the spirit or scope of the present invention.

For example, in the embodiment and modified examples, the chamber 21 may be formed in a circular tubular shape.

The invention is not to be considered as being limited by the foregoing description, and is only limited by the scope of the appended claims.

What is claimed is:

1. An industrial ejector comprising:

a Laval nozzle in which a first channel which has a throat and along which a fluid flows in a first direction is formed; and a main body having a tubular shape and having a second channel, the Laval nozzle being disposed in the main body and fixed to a part of an inner surface of the main body and the second channel being formed between an opposite part of the inner surface of the main body and the Laval nozzle, wherein the second channel is disposed at a first side of the channel in a second direction perpendicular to the first direction, wherein a cutout that comprises an opening is obliquely cut and formed in an end of the first channel at a downstream side and is inclined toward the first side in the upstream direction and toward the second channel, wherein the first channel and the second channel are disposed in parallel, and wherein the opening obliquely cut is arranged along an inner surface of the main body.

2. The industrial ejector according to claim 1, wherein an angle formed by the first direction and the opening is greater than 0° and smaller than 90°.

3. The industrial ejector according to claim 2, wherein a Mach number of a flow velocity of the fluid flowing in the throat is 1.

4. The industrial ejector according to claim 1, wherein a Mach number of a flow velocity of the fluid flowing in the throat is 1.

5. The industrial ejector according to claim 1, wherein an angle θ1 formed by the first direction and the opening is greater than 0° and is smaller than 90°, wherein the angle θ1 is an angle that is formed by an axis along the first direction and the opening, and is formed at the downstream side relative to the opening and at a second side which is a side opposite to the first side relative to the axis, wherein an angle θ2 at which the opening is directed closer to the second channel than the first direction is greater than 0°, and is smaller than 90°, and wherein, thereby the Laval nozzle is configured not to be rotationally symmetric around the axis along the first direction.

* * * * *